US008063848B2

(12) United States Patent
Perkins, III

(10) Patent No.: US 8,063,848 B2
(45) Date of Patent: Nov. 22, 2011

(54) X, $K_u$, K BAND OMNI-DIRECTIONAL ANTENNA WITH DIELECTRIC LOADING

(75) Inventor: Thomas O Perkins, III, Bedford, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 386 days.

(21) Appl. No.: 12/326,118

(22) Filed: Dec. 2, 2008

(65) Prior Publication Data

US 2010/0134367 A1 Jun. 3, 2010

(51) Int. Cl.
*H01Q 15/08* (2006.01)

(52) U.S. Cl. ..... 343/911 R; 343/702; 343/700 MS

(58) Field of Classification Search ..... 343/702, 343/700 MS, 911 R
See application file for complete search history.

(56) References Cited

U.S. PATENT DOCUMENTS

| | | | | |
|---|---|---|---|---|
| 3,611,390 | A | 10/1971 | Chiron et al. | |
| 4,740,793 | A * | 4/1988 | Wolfson et al. | 343/700 MS |
| 5,072,232 | A | 12/1991 | Korner | |
| 5,451,968 | A | 9/1995 | Emery | |
| 5,717,408 | A | 2/1998 | Sullivan et al. | |
| 5,880,696 | A | 3/1999 | Koleda | |
| 6,294,953 | B1 | 9/2001 | Steeves | |
| 6,697,028 | B1 | 2/2004 | Gothard et al. | |
| 6,940,463 | B2 * | 9/2005 | Ittipiboon et al. | 343/729 |
| 2002/0196178 | A1 * | 12/2002 | Beard | 342/42 |
| 2003/0103008 | A1 * | 6/2003 | Petropoulos et al. | 343/702 |
| 2007/0001773 | A1 * | 1/2007 | Oxborrow | 331/154 |
| 2007/0024505 | A1 * | 2/2007 | Geisheimer et al. | 343/700 MS |
| 2007/0103369 | A1 | 5/2007 | Ratni et al. | |
| 2007/0152885 | A1 * | 7/2007 | Sorvala | 343/700 MS |
| 2007/0164894 | A1 * | 7/2007 | Sherman et al. | 342/25 F |
| 2007/0290879 | A1 * | 12/2007 | Tuttle | 340/825.49 |
| 2008/0272890 | A1 * | 11/2008 | Nitzan et al. | 340/10.1 |

OTHER PUBLICATIONS

PCT Search Report dated Jan. 26, 2010 of Patent Application No. PCT/US2009/066330 filed Dec. 2, 2009.

Lapierre, M. et al., "Ultra Wideband Monopole/Dielectric Resonator Antenna", IEEE Microwave and Wireless Components Letters, Jan. 2005, pp. 7-9, vol. 15, No. 1.

* cited by examiner

*Primary Examiner* — Jacob Y Choi
*Assistant Examiner* — Graham Smith
(74) *Attorney, Agent, or Firm* — Vern Maine & Associates; David A. Rardin

(57) ABSTRACT

An X, $K_u$, and K-band omni-directional antenna with dielectric loading is disclosed. It comprises a conductor with a loading dielectric resonator and a ground plane. Broad frequency coverage from 7.5 to 26 GHz includes uniform azimuthal coverage from +10 to +70 degrees. The antenna can be used generally in microwave communications including Digital Radio Frequency Tags (DRaFTs) communicating with airborne and satellite platforms.

20 Claims, 6 Drawing Sheets

100

200

400

500

X, $K_u$, K BAND OMNI-DIRECTIONAL ANTENNA WITH DIELECTRIC LOADING

STATEMENT OF GOVERNMENT INTEREST

The invention was made with United States Government support under Contract No. W15P7T-05-C-P627 awarded by the U.S. Army. The United States Government has certain rights in this invention.

FIELD OF THE INVENTION

This invention relates to microwave antennas and, more particularly, to the utilization of an X, $K_u$, and K band omni-directional antenna with dielectric loading.

BACKGROUND OF THE INVENTION

Broadband microwave communications provide the opportunity for miniaturized systems generally unobtainable at lower frequencies. Components, including antennas, can make these systems very expensive, however.

Radio frequency communication with air and space platforms provides the opportunity to remotely track objects over large distances. Military operations especially have a need for tracking technology for air-to-ground Combat Identification (CID). This generally includes microwave communications.

As an example, a Digital Radio Frequency Tag (DRaFT) can provide flexible technology to allow radars such as Moving Target Indicator (MTI) and Synthetic Aperture Radar (SAR) to receive data from ground devices. At the frequencies used by these systems, small, lightweight and affordable RF Tags can provide for data extraction from unattended ground sensors and communication with vehicles and personnel throughout an area. This is particularly useful for the identification and location of combined units. Other advanced tag functions include additional communications capabilities for enhanced interoperability with identification and communications systems.

Ultra-wideband (UWB) systems provide the benefit of radio transmissions that use a very large bandwidth. This can convey more signal information including data or radar resolution. Although no set bandwidth defines a signal as UWB, systems using bandwidths greater than about ten percent are typically called UWB systems. A typical UWB system may use a bandwidth of one-third to one-half of the center frequency.

Broadband operation in the X, $K_u$, and K bands is desirable, but applicable biconical antennas are cost prohibitive and too large for applications. They can cost thousands of dollars and occupy a volume as large as a tennis ball. Currently, multiple antennas are required to cover this bandwidth, especially both above and below the horizontal plane.

FIG. 1 is a diagram of a prior-art microwave biconical antenna 100. It is costly and can be difficult to integrate into a microwave system.

FIG. 2 is a plot 200 of the FIG. 1 prior-art biconical antenna H-plane pattern. It has been normalized based on the average signal from −135 degrees to +135 degrees.

Current microwave broadband antennas are expensive, difficult to integrate into systems, and can have relatively narrow operating frequencies.

SUMMARY OF THE INVENTION

The above problems of biconical and similar antennas are solved by providing an X, $K_u$, and K-band omni-directional antenna with dielectric loading. Advantages of the new antenna are that it is small, very inexpensive, omni-directional, simply constructed, and easily reproducible. It includes the microwave frequency bands of 8 to 12 GHz (X), 12 to 18 GHz ($K_u$), and 18 to 27 GHz (K). This is approximately twice the bandwidth of prior antennas. Scaling dimensions larger results in performance at lower frequencies. Applications include car-top deployment.

Embodiments include a dielectrically loaded omnidirectional broadband antenna comprising a ground plane; a conductor; and a dielectric resonator whereby the antenna is loaded. In embodiments, the radiation is in the X, Ku, and K-bands and the resonant frequency is about approximately between 7.5 GHz and 26 GHz. In other embodiments the dielectric resonator is proximate the ground plane or in contact with the ground plane. For embodiments, the dielectric resonator is a toroid with rectangular cross section of about approximately 99.5 percent pure alumina and the relative dielectric constant $\in_r$ of the dielectric resonator is about approximately 9.7. In yet other embodiments, the length of the conductor is about approximately 0.387 inch, the ground plane comprises a copper disk, and the ground plane diameter is about approximately six inches. For embodiments, the radiation polarization is about approximately vertical, the radiation pattern provides transmit and receive reciprocity, and the radiation pattern is substantially omnidirectional in the plane of the ground plane. In antenna embodiments, the radiation pattern azimuth coverage is uniform between about approximately plus ten and about approximately plus seventy degrees.

Other embodiments include a dielectrically loaded omnidirectional microwave antenna comprising a ground plane; a conductor having a length of 0.387 inch and a diameter of about approximately 0.050 inch; and a dielectric resonator having an outer diameter of about approximately 0.290 inch, an inner diameter of about approximately 0.102 inch and height of about approximately 0.151 inch; whereby the antenna is loaded.

An embodiment is a microwave frequency tag comprising at least one broadband microwave antenna comprising a ground plane; a conductor; a dielectric resonator whereby the antenna is loaded; and circuitry in electrical communication with the antenna whereby the microwave frequency tag communicates with a transceiver. For embodiments, the tag is associated with personnel, the tag is associated with vehicles, and the tag is a digital radio frequency tag (DRaFT). Other embodiments comprise two antennas in close proximity wherein there is less than 1 dB of gain pattern variation in azimuth.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Embodiments of the antenna are very small (one fortieth ¼₀th of a cubic inch), have good azimuth coverage from at least +10 degrees to at least +70 degrees elevation, and have extremely wide bandwidth from approximately 7.5 to approximately 26 GHz. They are very low cost and very simple to connect to a transmit/receive microwave apparatus. Embodiments have vertical polarization.

Figure 1:
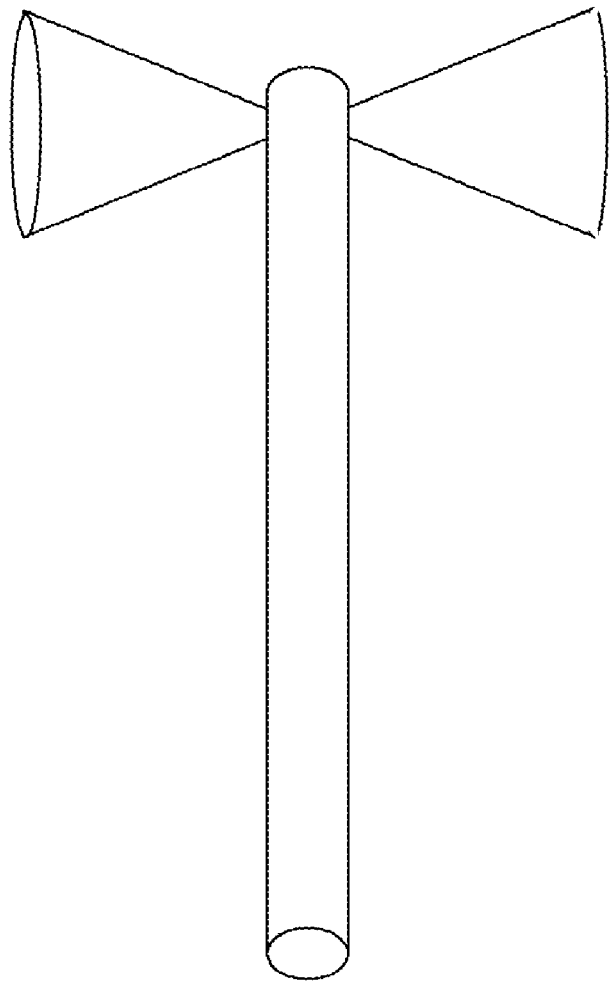
FIG. 1 (PRIOR ART)
FIG. 1 is a prior-art microwave biconical antenna.
Figure 2:
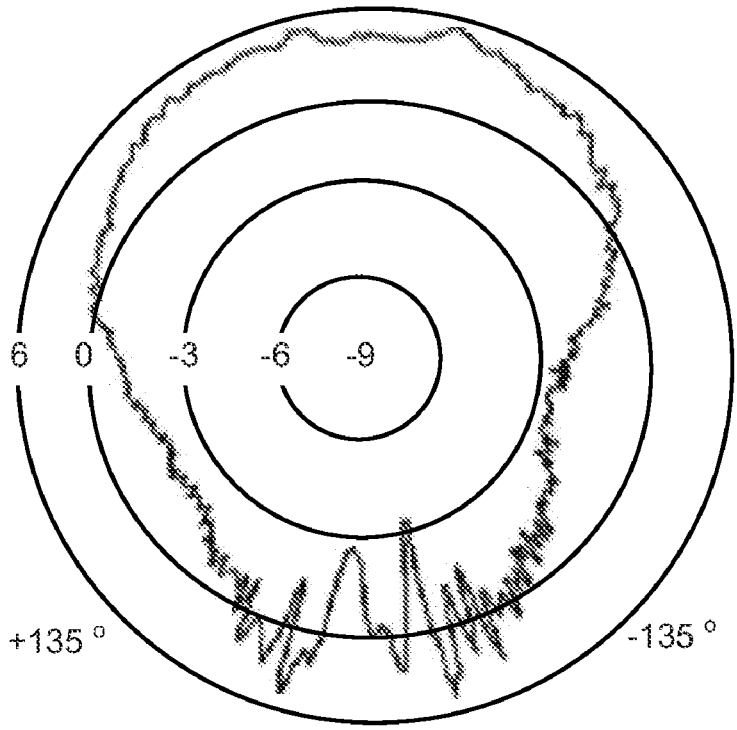
FIG. 2 (PRIOR ART)
FIG. 2 is a plot of the prior-art FIG. 1 biconical antenna H-plane pattern.
Figure 3:
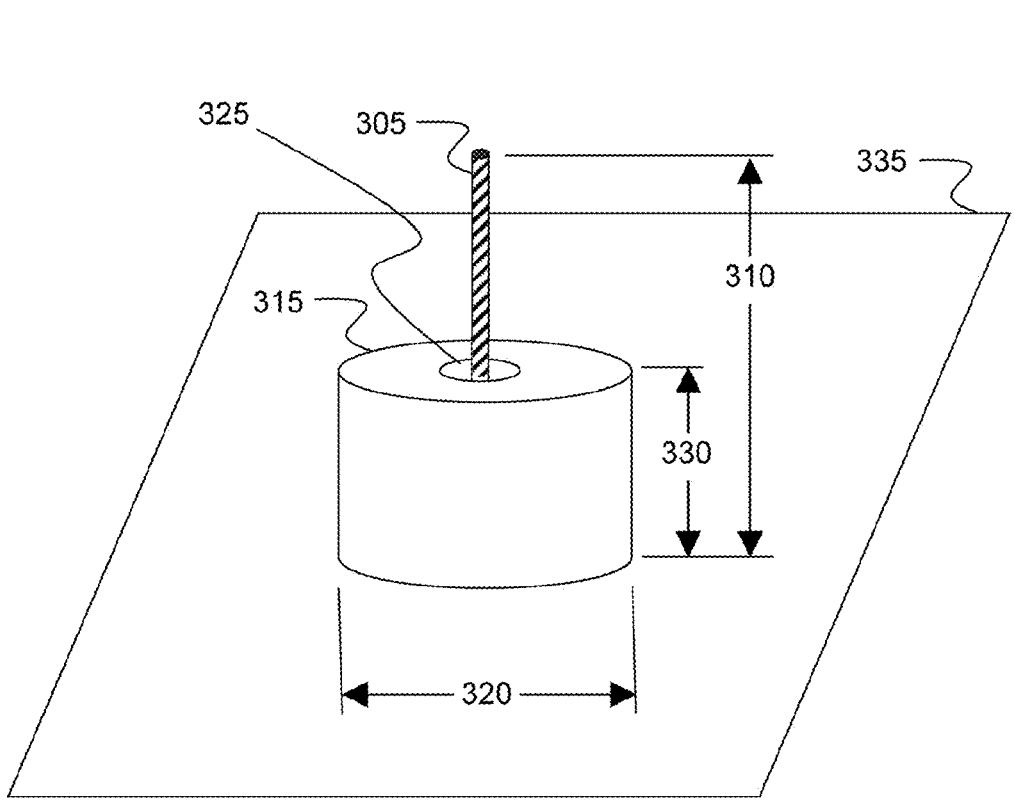
FIG. 3 is a simplified perspective diagrammatic illustration of an X, $K_u$, K-band omnidirectional antenna with dielectric loading configured in accordance with one embodiment of the present invention.

FIG. 3 is a simplified schematic illustration 300 of an embodiment of an X, $K_u$, K-band omnidirectional antenna with dielectric loading. Conductor 305 has a length 310 of 0.387 inch and a diameter of 0.050 inch. Dielectric resonator 315 has an outer diameter 320 of 0.290 inch and inner diameter 325 of 0.102 inch. Its height 330 is 0.151 inch. Dielectric resonator 315 embodiments are made of aluminum oxide $Al_2O_3$, but other dielectrics may be used. Dielectric resonator 315 provides loading to the antenna system. Ground plane 335 can incorporate a backside 50 ohm coaxial feed (not shown). In embodiments, feedpoint is flush with groundplane 335. Ground plane 335 can be greater than or equal to approximately the wavelength of the antenna's lowest frequency. Ground plane 335 can be of varied shape. Nonlimiting examples include a circle or rectilinear shape. Size can include an approximate six inch diameter, smaller or larger depending on application requirements. Materials can include copper, brass, and aluminum. Dielectric resonator 315 of the antenna is located on ground plane 335, with no separation. Embodiments include a four-hole flange subminiature A (SMA) connector and a 99.5 percent alumina dielectric toroid 315 with rectangular cross section and relative dielectric constant $\in_r$ of 9.7. Scaling dimensions larger results in performance at lower frequencies.

Figure 4:
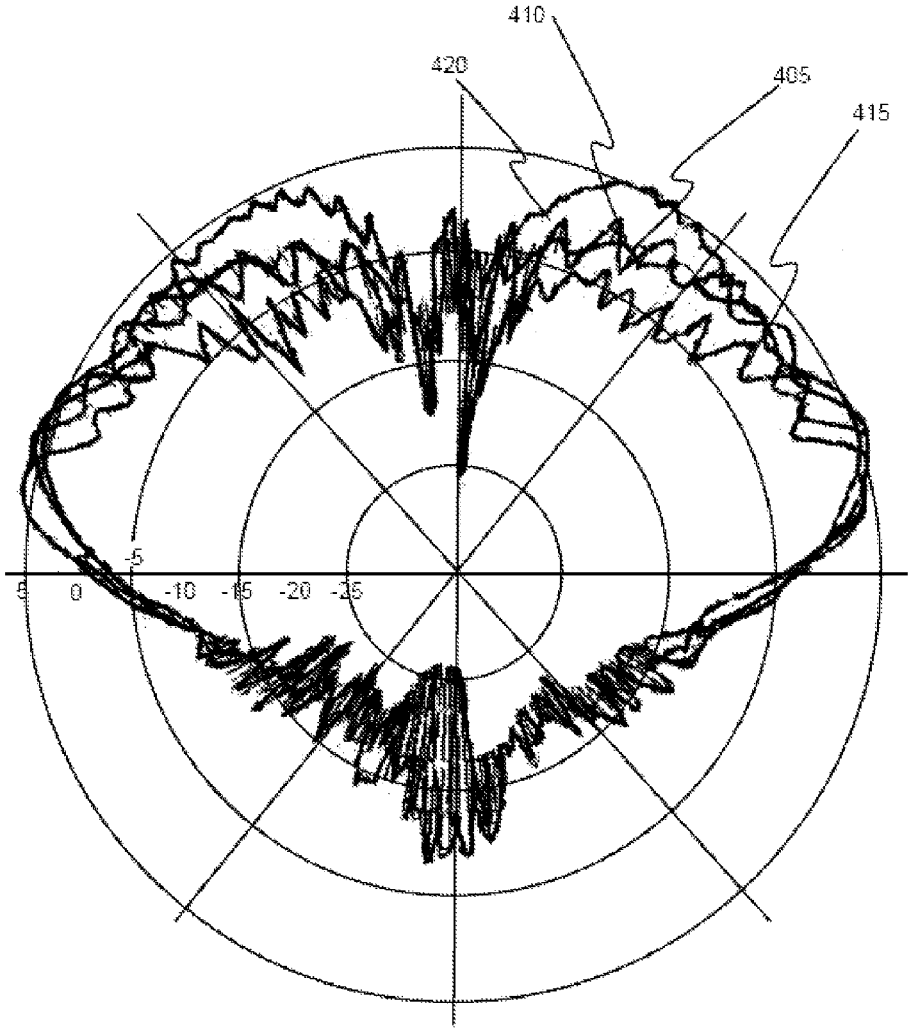
FIG. 4 is a polar plot of the pattern of the antenna represented in FIG. 3 configured in accordance with one embodiment of the present invention.

FIG. 4 is a polar plot 400 of the pattern of the antenna represented in FIG. 3. The scale ranges from +5 to −25 dBi. Four patterns shown are of 7 GHz 405, 9 GHz 410, 15 GHz 415, and 18 GHz 420. Elevation patterns show greater than +5 dBi gain from 10 to 25 degrees elevation. They exhibit good azimuth coverage from at least +10 degrees to at least +70 degrees. Performance in airborne communications benefits from this pattern. Maximum gain occurs in the direction of maximum range to an aircraft and is decreased overhead where range to the aircraft is least. This directs energy where it is most beneficial.

Figure 5:
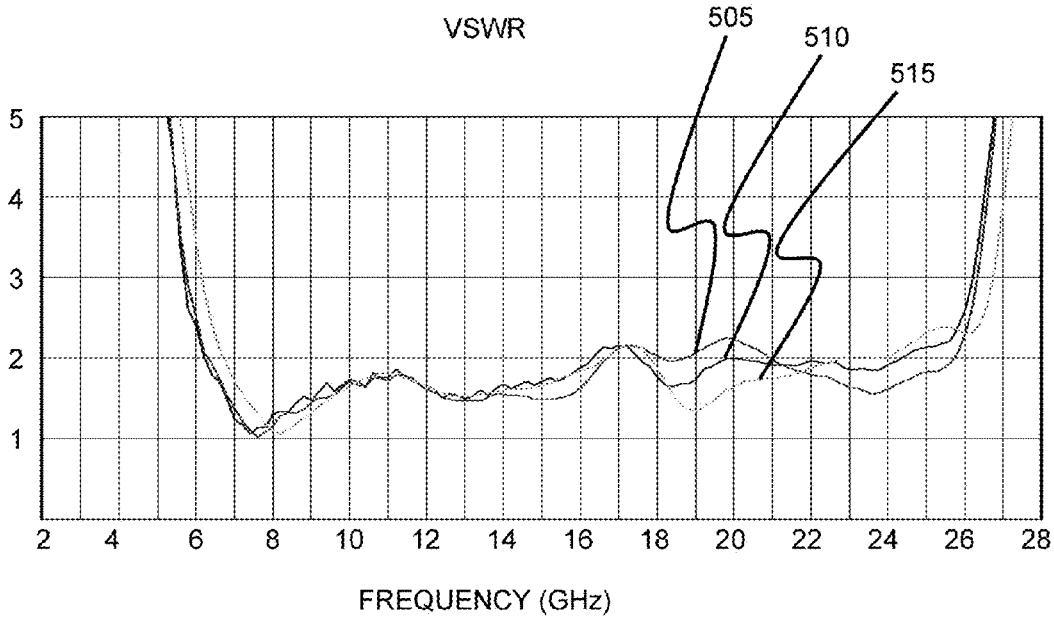
FIG. 5 is a voltage standing wave ratio (VSWR) plot of the pattern of the antenna represented in FIG. 3 configured in accordance with one embodiment of the present invention.

FIG. 5 is an input VSWR plot 500 of the pattern of the antenna represented in FIG. 3. The scale is from zero to five and covers 2 GHz to 28 GHz. It depicts the influence of ground plane size with curves 505 and 510 portraying larger ground planes and curve 515 a smaller ground plane. Each curve presents a VSWR between 1.0 and 2.5 for 6 GHz to 26 GHz. This is a distinguishing feature of this antenna. It is expected that dimensional scaling produces similar results for frequencies in addition to this band.

Figure 6:
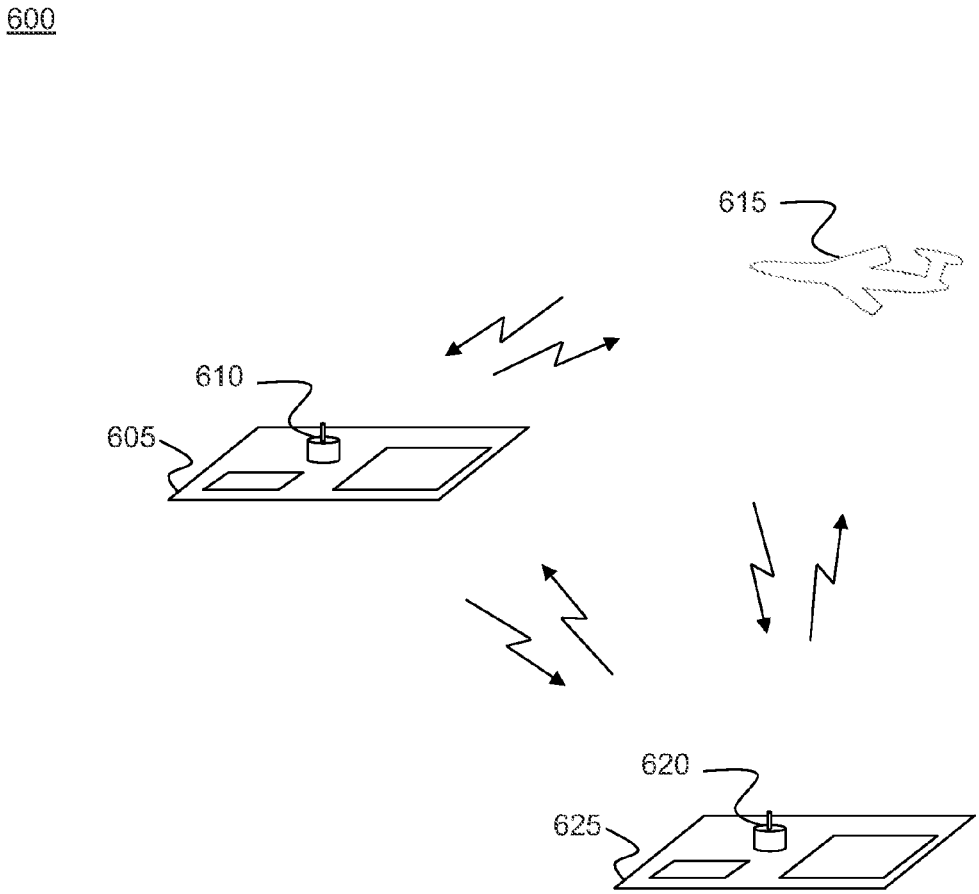
FIG. 6 is a simplified illustration of the subject antenna deployed in a broadband microwave DRaFT system configured in accordance with one embodiment of the invention.

FIG. 6 illustrates a simplified diagram of an embodiment of the subject antenna deployed in a broadband microwave Digital Radio Frequency Tag (DRaFT) system 600. DRaFT 605 includes broadband antenna 610 and is in communication with remote airborne platform 615. Circuitry on DRaFT 605 is in electrical communication with microwave antenna 610 and supports two-way communication with a tag communication device that can be other than an airborne platform 615. Also shown is a second DRaFT 625 also incorporating broadband antenna 620. DRaFTs 605 and 625 communicate with each other and remote platform 615.

In embodiments, two antennas perform transmit/receive functions. The mutual effects of two antennas in close proximity (approximately two wavelengths apart on a common ground plane) display only slight azimuth pattern perturbation. There is less than 1 dB of "wobble" as azimuth as the pattern is measured over 360 degrees (passive antenna rotated about the active antenna).

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A dielectrically loaded omnidirectional broadband antenna comprising:

a ground plane;

a conductor element wire having a length of 0.387 inch measured from said ground plane to distal end of said conductor element wire and a diameter of 0.050 inch; and a dielectric resonator having an outer diameter of 0.290 inch, an inner diameter of 0.102 inch, and height of 0.151 inch, whereby said antenna is loaded, and whereby voltage standing wave ratio (VSWR) of said antenna throughout entire range between frequencies of 6 GHz and 26 GHz is between 1.0 and 2.5.

2. The antenna of claim 1, wherein radiation is in the X, Ku, and K-bands, whereby radiation pattern azimuthal uniformity between +10 and +70 degrees from an axis of said azimuthal uniformity is between +2 dBi to +7 dBi at 7 GHz, −5 dBi to +7 dBi at 9 GHz, −8 dBi to +7 dBi at 15 GHz, and 0 dBi to +7 dBi at 18 GHz, wherein said axis of said azimuthal uniformity is taken to lie along said antenna's axis of symmetry.

3. The antenna of claim 2, wherein resonant frequency is between entire range of 7.5 GHz and 26 GHz.

4. The antenna of claim 1, wherein said dielectric resonator is proximate said ground plane.

5. The antenna of claim 1, wherein said dielectric resonator is in contact with said ground plane.

6. The antenna of claim 1, wherein said dielectric resonator is a toroid with rectangular cross section of about 99.5 percent pure alumina.

7. The antenna of claim 1, wherein the relative dielectric constant $\in_r$ of said dielectric resonator is about 9.7.

8. The antenna of claim 1, wherein said length of said conductor measured from said ground plane to distal end of said conductor element wire is 0.387 inch.

9. The antenna of claim 1, wherein said ground plane comprises a copper disk.

10. The antenna of claim 1, wherein said ground plane diameter is six inches.

11. The antenna of claim 1, wherein the radiation polarization is about vertical.

12. The antenna of claim 1, wherein the radiation pattern provides transmit and receive reciprocity.

13. The antenna of claim 1, wherein the radiation pattern is substantially omnidirectional in the plane of said ground plane.

14. The antenna of claim 1, wherein the radiation pattern azimuth coverage is uniform between about plus ten and about plus seventy degrees from an axis of azimuthal uniformity, wherein said axis of said azimuthal uniformity is taken to lie along said antenna's axis of symmetry.

15. A dielectrically loaded omnidirectional microwave antenna comprising:

a ground plane;

a conductor element free-standing wire having a length of 0.387 inch measured from said ground plane to distal end of said conductor element free-standing wire and a diameter of 0.050 inch; and a dielectric resonator having an outer diameter of 0.290 inch, an inner diameter of 0.102 inch and height of 0.151 inch; whereby said antenna is loaded, and whereby voltage standing wave ratio (VSWR) of said antenna throughout entire range between frequencies of 6 GHz and 26 GHz is between 1.0 and 2.5.

16. A microwave frequency tag comprising:

at least one broadband microwave antenna comprising:

a ground plane;

a conductor element wire having a length of 0.387 inch measured from said ground plane to distal end of said conductor element wire and a diameter of 0.050 inch;

a dielectric resonator having an outer diameter of 0.290 inch, an inner diameter of 0.102 inch, and height of 0.151 inch, whereby said antenna is loaded, whereby voltage standing wave ratio (VSWR) of said antenna throughout entire range between frequencies of 6 GHz and 26 GHz is between 1.0 and 2.5; and circuitry in electrical communication with said antenna whereby said microwave frequency tag communicates with a transceiver.

17. The microwave frequency tag of claim 16, wherein said tag is associated with personnel.

18. The microwave frequency tag of claim 16, wherein said tag is associated with vehicles.

19. The microwave frequency tag of claim 16, wherein said tag is a digital radio frequency tag (DRaFT) communicating with airspaceborne radar.

20. The microwave frequency tag of claim 16, comprising: two said antennas in close proximity wherein there is less than 1 dB of gain pattern variation in azimuth.

* * * * *